US009255443B2

(12) United States Patent
Chang

(10) Patent No.: US 9,255,443 B2
(45) **Date of Patent: *Feb. 9, 2016**

(54) WINDOW COVERING

(71) Applicant: NIEN MADE ENTERPRISE CO., LTD., Taichung (TW)

(72) Inventor: Chih-Yao Chang, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 72 days.

This patent is subject to a terminal disclaimer.

(21) Appl. No.: 14/086,016

(22) Filed: Nov. 21, 2013

(65) Prior Publication Data

US 2015/0136335 A1 May 21, 2015

(51) Int. Cl.

| | |
|---|---|
| ***E06B 9/30*** | (2006.01) |
| ***E06B 9/32*** | (2006.01) |
| ***E06B 9/303*** | (2006.01) |
| ***E06B 9/306*** | (2006.01) |
| ***E06B 9/307*** | (2006.01) |
| *E06B 9/262* | (2006.01) |

(52) U.S. Cl.

CPC . *E06B 9/32* (2013.01); *E06B 9/303* (2013.01); *E06B 9/306* (2013.01); *E06B 9/307* (2013.01); *E06B 2009/2627* (2013.01)

(58) Field of Classification Search

CPC ..... E06B 9/32; E06B 9/322; E06B 9/326; E06B 9/303

USPC ..... 160/168.1 R, 173 R, 176.1 R, 177 R

See application file for complete search history.

(56) References Cited

U.S. PATENT DOCUMENTS

| | | | | |
|---|---|---|---|---|
| 2,594,637 | A * | 4/1952 | Gertzon | 160/168.1 R |
| 4,333,510 | A * | 6/1982 | Fox | 160/177 R |
| 4,567,930 | A * | 2/1986 | Fischer | 160/166.1 |
| 4,643,238 | A * | 2/1987 | Tachikawa et al. | 160/168.1 R |
| 5,538,066 | A * | 7/1996 | Liu | 160/173 R |
| 5,671,793 | A * | 9/1997 | Lee | 160/168.1 R |
| 5,799,715 | A * | 9/1998 | Biro et al. | 160/170 |
| 6,095,228 | A * | 8/2000 | Liu | 160/173 R |
| 6,189,596 | B1 * | 2/2001 | Chen | 160/176.1 R |
| 6,802,356 | B2 * | 10/2004 | Lin | 160/168.1 R |
| 6,837,294 | B2 * | 1/2005 | Cheng et al. | 160/84.04 |
| 6,962,187 | B2 * | 11/2005 | Gilmore et al. | 160/170 |
| 6,991,020 | B1 * | 1/2006 | Cheng et al. | 160/168.1 R |
| 7,028,739 | B2 * | 4/2006 | Hsu | 160/173 R |
| 7,100,664 | B2 * | 9/2006 | Hsu | 160/115 |
| 7,258,297 | B2 * | 8/2007 | Liu | 242/398 |
| 7,264,035 | B2 * | 9/2007 | Rossato et al. | 160/178.2 |
| 7,343,957 | B2 * | 3/2008 | Lin | 160/168.1 R |
| 7,424,905 | B2 * | 9/2008 | Lai | 160/168.1 R |
| 7,493,932 | B2 * | 2/2009 | Cheng | 160/173 R |

(Continued)

*Primary Examiner* — Katherine Mitchell
*Assistant Examiner* — Johnnie A Shablack
(74) *Attorney, Agent, or Firm* — Ming Chow; Sinorica, LLC

(57) ABSTRACT

A window covering includes a headrail, a bottom rail, a shading member, two pulley assemblies, and a cord. The shading member is between the headrail and the bottom rail. The pulley assemblies are received in the headrail, each of which has a frame and a pulley. The frame has an opening, and the pulley is connected to the frame. The cord is a woven Y-shaped cord, having a single control section and two lift sections. The cord runs over the pulleys of the pulley assemblies, the single control section extends out of the headrail to be operated by a user, and the lift sections extend out of the frames via the openings respectively to connect to the bottom rail through the shading member.

9 Claims, 16 Drawing Sheets

(56) References Cited

U.S. PATENT DOCUMENTS

| | | | | |
|---|---|---|---|---|
| 7,832,453 | B2 * | 11/2010 | Lin | 160/168.1 R |
| 8,002,012 | B2 * | 8/2011 | Cheng | 160/170 |
| 8,931,539 | B1 * | 1/2015 | Jaggli | 160/168.1 R |
| 2003/0062137 | A1 * | 4/2003 | Su et al. | 160/178.1 R |
| 2006/0283560 | A1 * | 12/2006 | Lai | 160/168.1 R |
| 2008/0073038 | A1 * | 3/2008 | Cheng | 160/168.1 R |
| 2012/0118515 | A1 * | 5/2012 | Chen | 160/170 |
| 2014/0246156 | A1 * | 9/2014 | Dorny et al. | 160/172 R |
| 2014/0332170 | A1 * | 11/2014 | Chang | 160/84.02 |
| 2014/0352894 | A1 * | 12/2014 | Chang | 160/84.02 |
| 2015/0020980 | A1 * | 1/2015 | Franssen | 160/84.01 |

* cited by examiner

WINDOW COVERING

BACKGROUND OF THE INVENTION

1. Technical Field

The present invention relates to a covering of an opening of a building, and more particularly to a window covering.

2. Description of Related Art

A conventional window covering includes a headrail, a bottom rail, and slats between the headrail and the bottom rail. The conventional window covering usually has two cords, each of which has an end fixed to the bottom rail, and then passing through the slats (this section is called lift cord), running over pulleys in the headrail, and then extending out of the headrail (this section is called control cord). Therefore, a user may pull or release the control cords to lift or lower the bottom rail.

For balance of the bottom rail, there must be two or more cords in the conventional window covering, which means there will be a plurality of control cords. The control cords always gets twisted after pulling or releasing for several times, and the twisted control cords are harmful to lift and lower the bottom rail. Furthermore, multiple control cords may lead to accidents. Children might be strangled by the control cords. In addition, sometimes the control cords are not moved synchronously, and that will make the bottom rail lean. In some window coverings, they provide a cord connector to collect the control cords, however, it only has limited function.

BRIEF SUMMARY OF THE INVENTION

In view of the above, the primary objective of the present invention is to provide a window covering without the drawback of multiple control cords of the conventional window covering.

In order to achieve the objective of the present invention, a window covering of the present invention includes a headrail, a bottom rail, a shading member, two pulley assemblies, and a cord. The shading member is between the headrail and the bottom rail. The pulley assemblies are received in the headrail, each of which has a pulley. The pulley is provided in the headrail. The cord runs over the pulleys of the pulley assemblies. The cord has a single control section and at least two lift sections, and the lift sections are connected to an end of the single control section. The single control section extends out of the headrail to be operated by a user, and the lift sections extend out of the headrails via the openings respectively to connect to the bottom rail through the shading member. The end of the single control section, which connects to the lift sections is always received in the headrail.

With such design, it may prevent multiple cords' twisting, lower the chance of a malfunction, and make the replacement easier.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
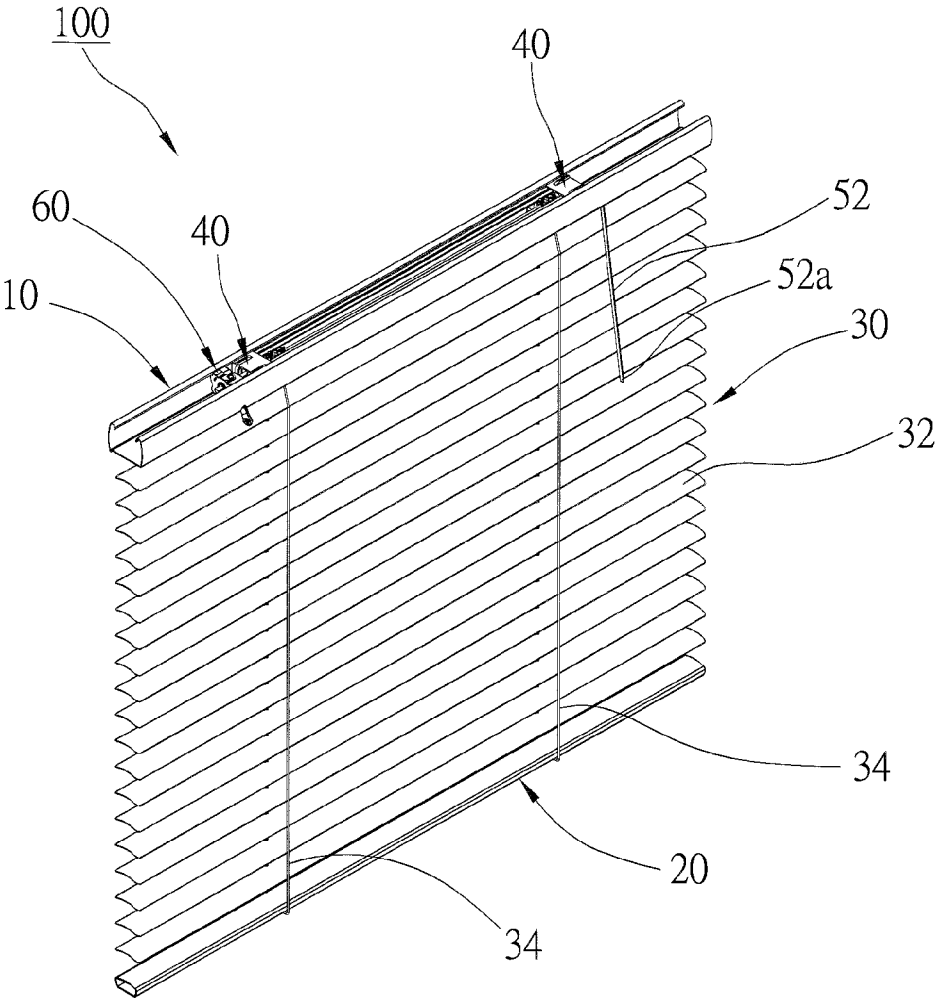
FIG. 1 is a perspective view of a first preferred embodiment of the present invention, showing the bottom rail being lowered.
Figure 2:
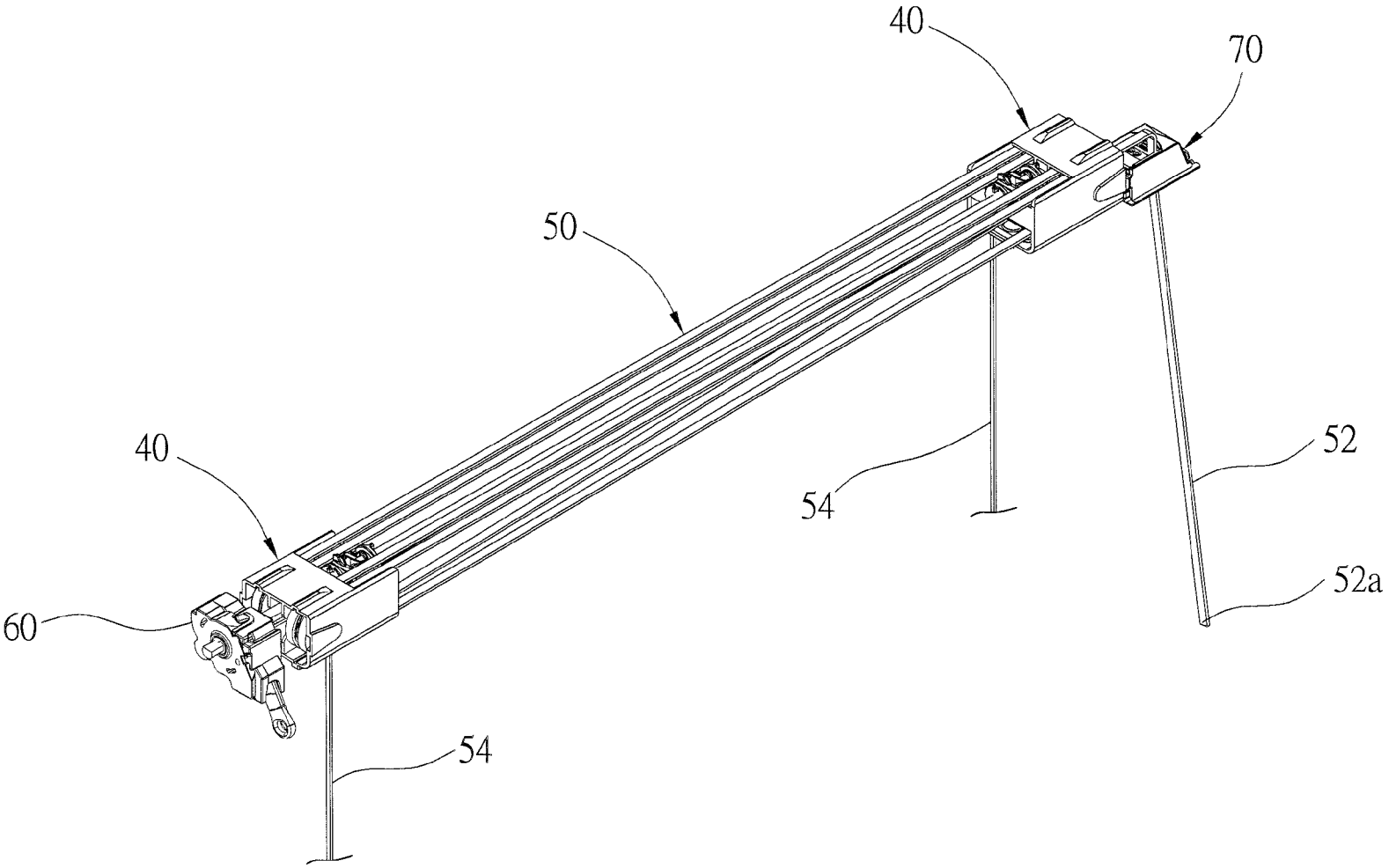
FIG. 2 is a perspective view of the pulley assembly and the cord of the first preferred embodiment of the present invention.

As shown in FIG. 1 to FIG. 4, a window covering 100 of the first preferred embodiment of the present invention includes a headrail 10, a bottom rail 20, a shading member 30, two pulley assemblies 40, a cord 50, and a tilting assembly 60.

The headrail 10 will be fixed on a wall. The shading member 30 has a plurality of parallel slats 32, which are between the headrail 10 and the bottom rail 20, and are connected to the headrail 10 and the bottom rail 20 through ladders 34. The ladders 34 support and tilt slats 32. The pulley assemblies 40 are received in the headrail 10, each of which has a frame 42, a pulley 44, and an axle 46.

Figure 5:
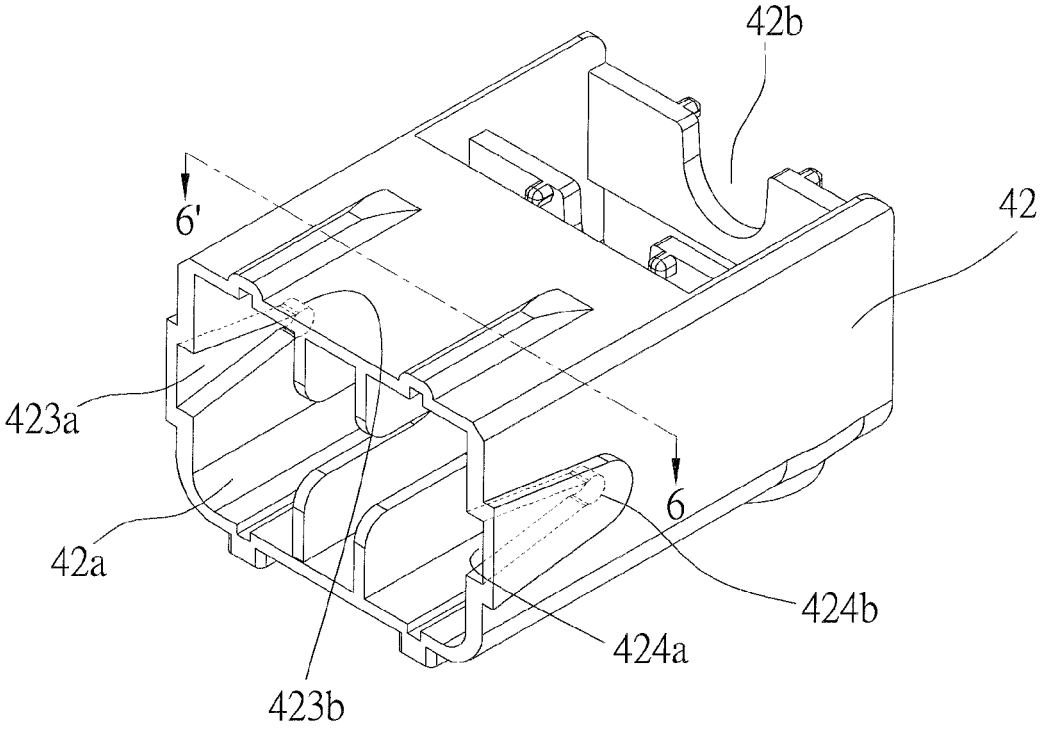
FIG. 5 is a perspective view of the frame of the pulley assembly of the first preferred embodiment of the present invention.
Figure 6:
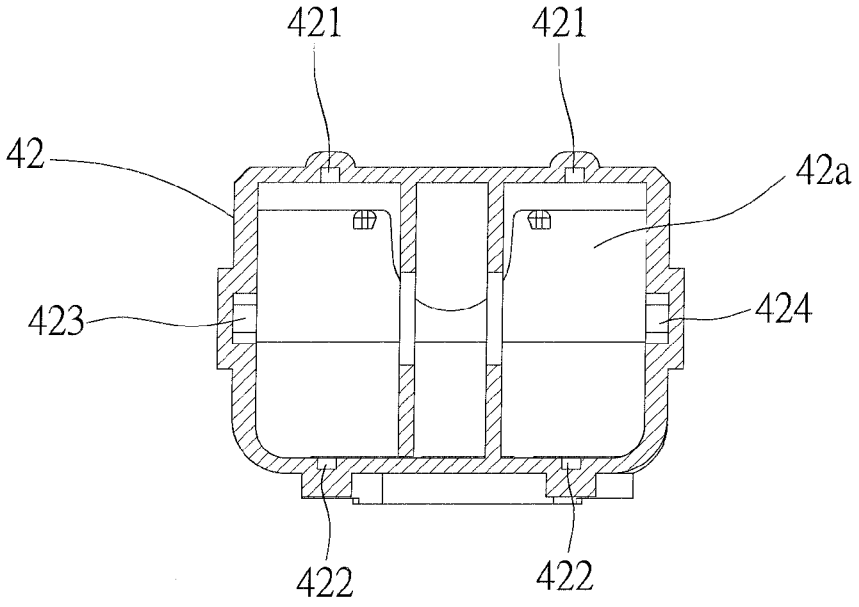
FIG. 6 is a sectional view of the 6-6 line in FIG. 5.

As shown in FIG. 5 and FIG. 6, the frame 42 is a rectangular hollow member, having four walls at a top, a bottom, a left, and a right thereof, and has a room 42*a* within the walls. The room 42*a* is open at a front side of the frame 42. Top and bottom walls of the room 42*a* has four first locking slots, two of which are on the top wall, and the other two of which are on the bottom wall. The first locking slots on the top wall are called top locking slots 421, and those on the bottom wall are called bottom locking slots 422. The top locking slots 421 are aligned with the bottom locking slots 422 respectively. The side walls of the room 42*a* further have two second locking slots, one of which is on the left wall (called left locking slot 423), and the other is on the right wall (called right locking slot 424). The left locking slot 423 is aligned with the right locking slot 424. Theses locking slots 421-424 are open at the front side of the frame 42. The frame 42 further has a rear wall on a rear side thereof. The rear wall has a holding portion 42*b*, which is a recess on a top end of the rear wall. The bottom wall has several openings 42*c* (referring to FIG. 4).

Figure 7:
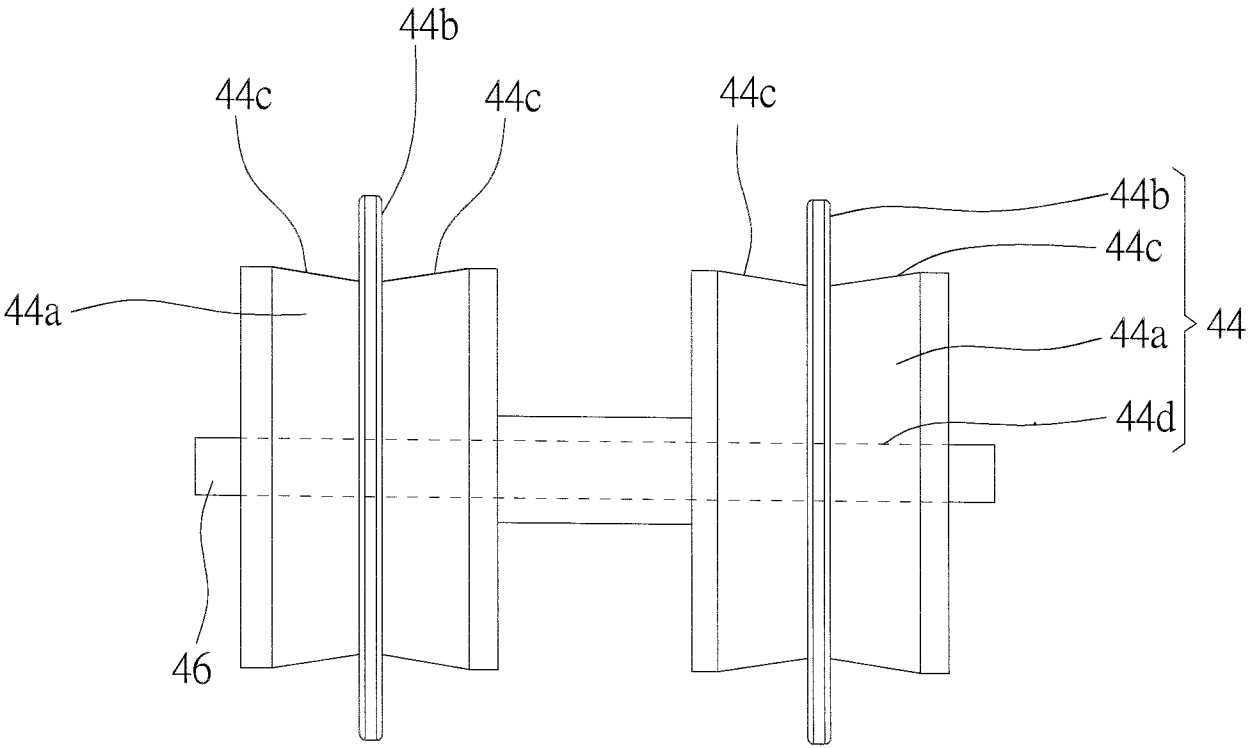
FIG. 7 is a lateral view of the pulley and the shaft of the first preferred embodiment of the present invention.
Figure 8:
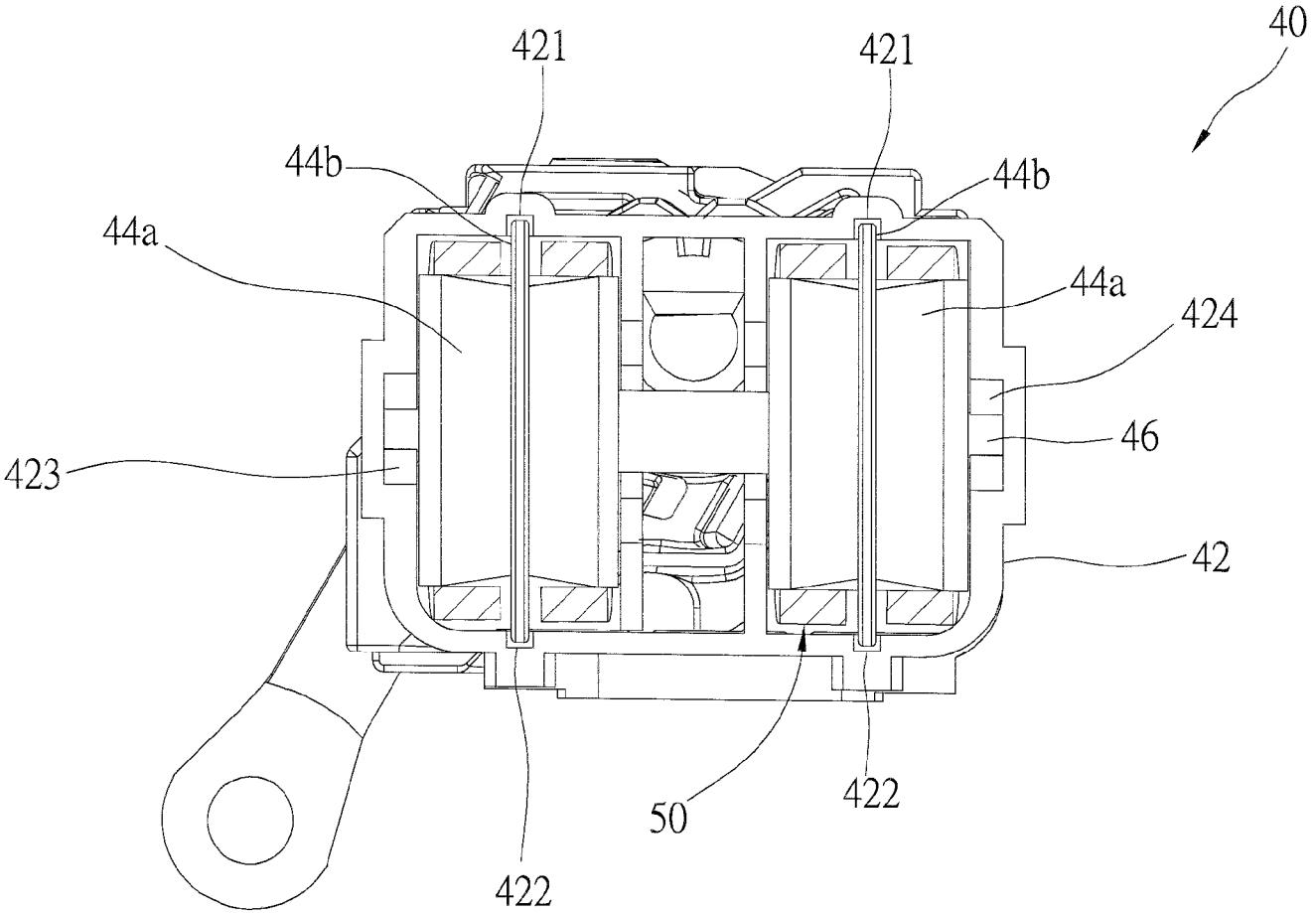
FIG. 8 is a lateral view of a pulley assembly and the cord of the first preferred embodiment of the present invention.

As shown in FIG. 7, the pulley 44 has two side-by-side wheels 44*a*, and each wheel 44*a* has a protrusion 44*b* around a circumference thereof. The protrusion 44*b* divides the circumference of the wheel 44*a* into two carrier portions 44*c*. Each carrier portion 44*c* slopes downwards from an edge of the circumference to protrusion 44*b*. Each wheel 44*a* has a bore 44*d* at a center thereof.

The axle 46 is inserted into the bores 44*d* of the wheels 44*a*. The pulley 44 and the axle 46 are received in the room 42*a* of the frame 42. The left locking slot 423 and the right locking slot 424 of the frame 42 each has an open end 423*a*, 424*a* at the front side of the frame 42 and a closed end 423*b*, 424*b* opposite to the open end 423*a*, 424*a* as shown in FIG. 5. The width of the locking slot 423, 424 at the open end 423*a*, 424*a* is greater than that at the closed end 423*b*, 424*b*. The left locking slot 423 and the right locking slot 424 each has a round portion at the closed end 423*b*, 424*b*. Opposite ends of the axle 46 engage the left locking slot 423 and the right locking slot 424 via the open end 423*a*, 424*a*, and stop in the round portions at the closed end 423*b*, 424*b*, therefore the pulley 44 is provided in the headrail 10 through the frame 42. The wider open ends 423*a*, 424*a* make the engagement of the axle 46 easier. At the same time, the protrusions 44*b* engage the top locking slots 421 and the bottom locking slots 422 respectively. As a result, the pulley 44 is received in the frame 42 for free rotation. In practices, the pulley 44 may be mounted in the headrail 10 without the frame 42. In an embodiment, the axle 46 has its opposite ends connected to the headrail 10 directly to mount the pulley 44 in the headrail 10 for free rotation.

Figure 3:
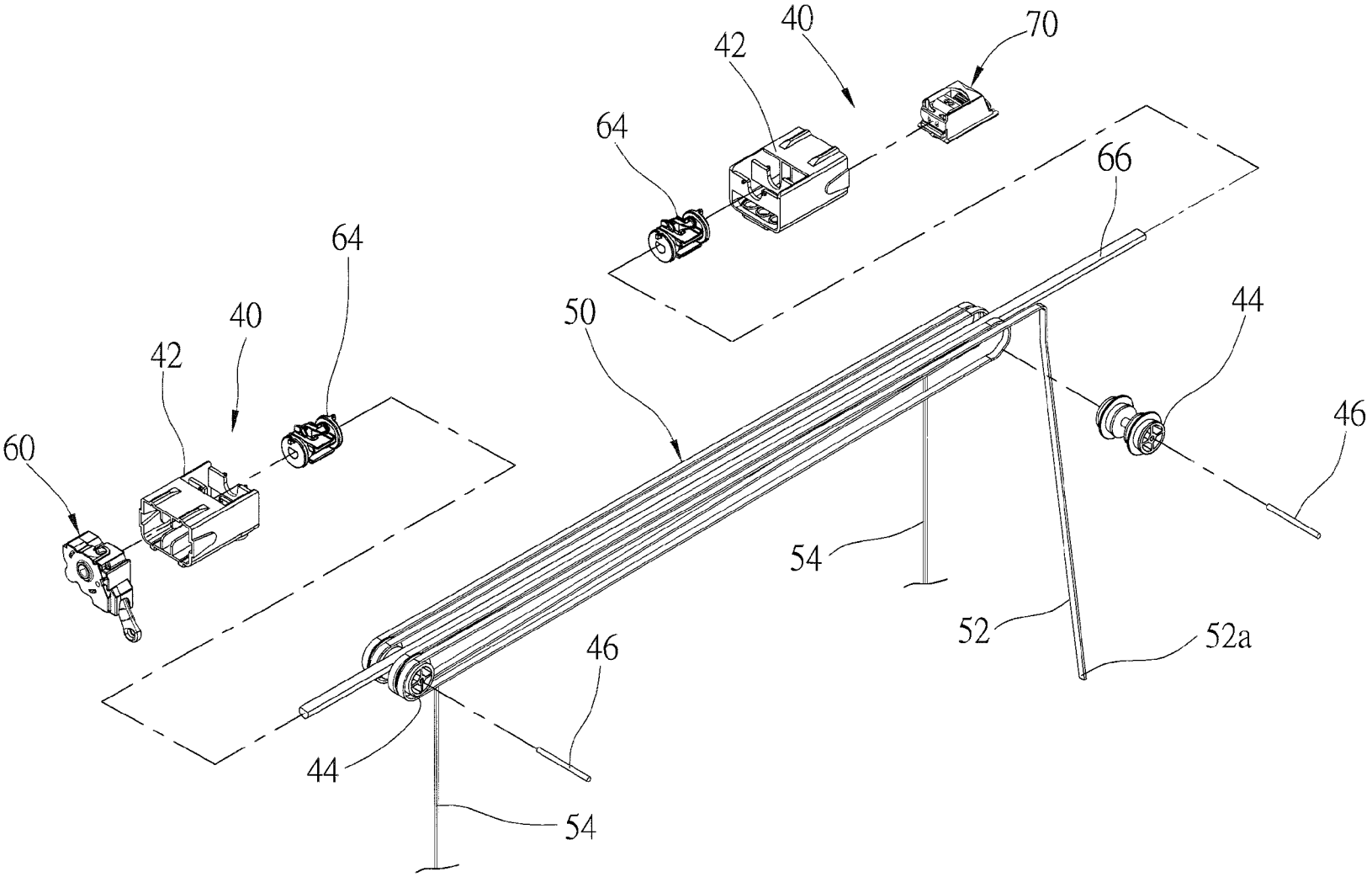
FIG. 3 is an exploded view of FIG. 2.
Figure 4:
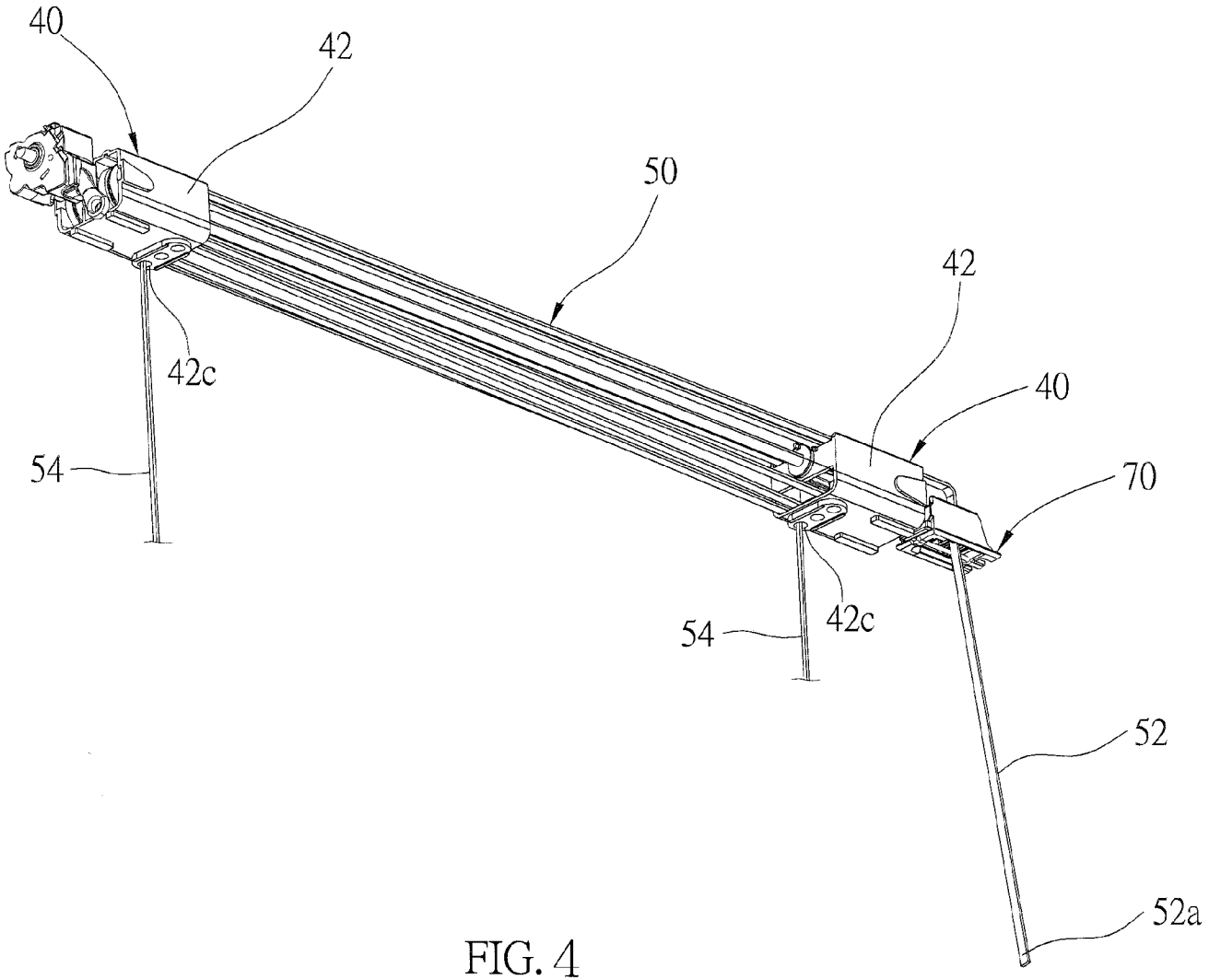
FIG. 4 is another perspective view of the pulley assembly and the cord of the first preferred embodiment of the present invention.
Figure 9:
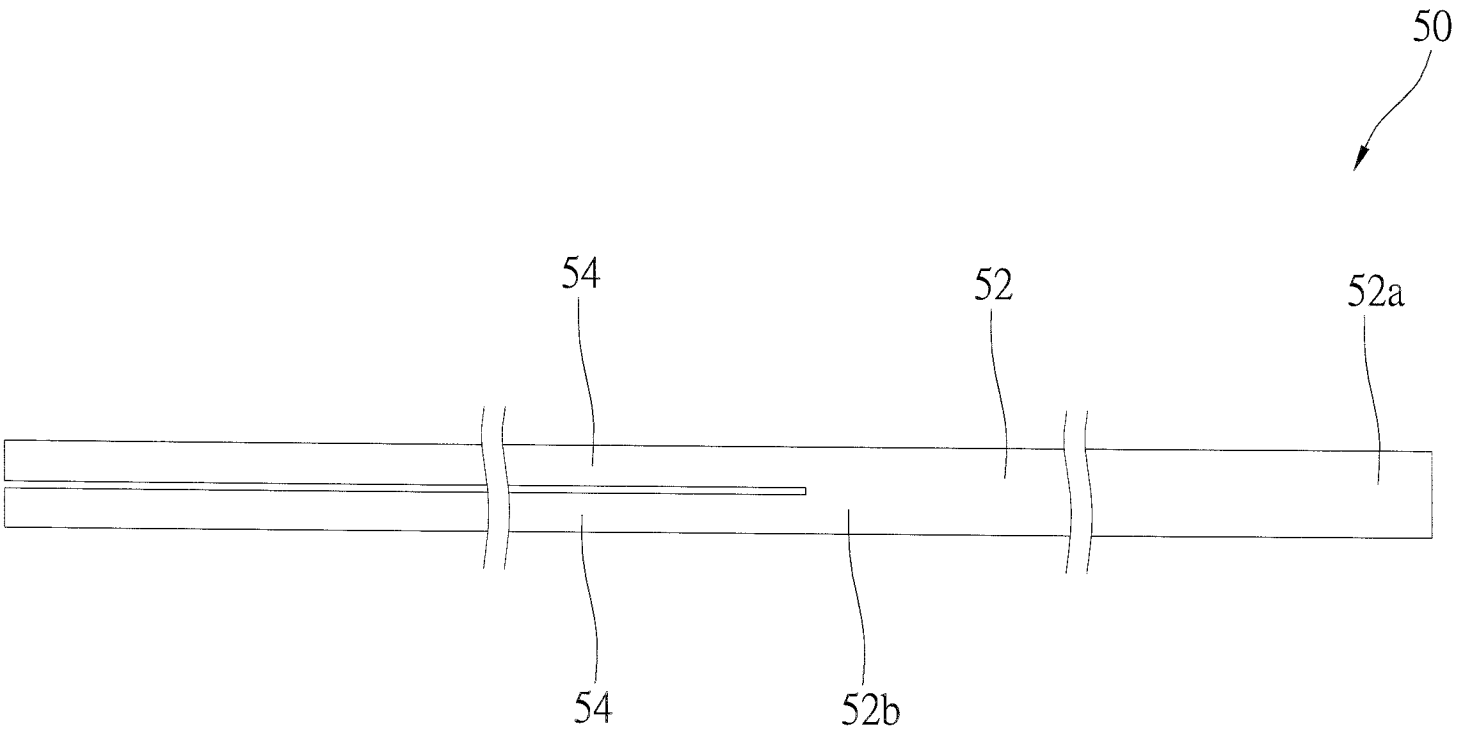
FIG. 9 is a top view of the cord of the first preferred embodiment of the present invention.
Figure 10:
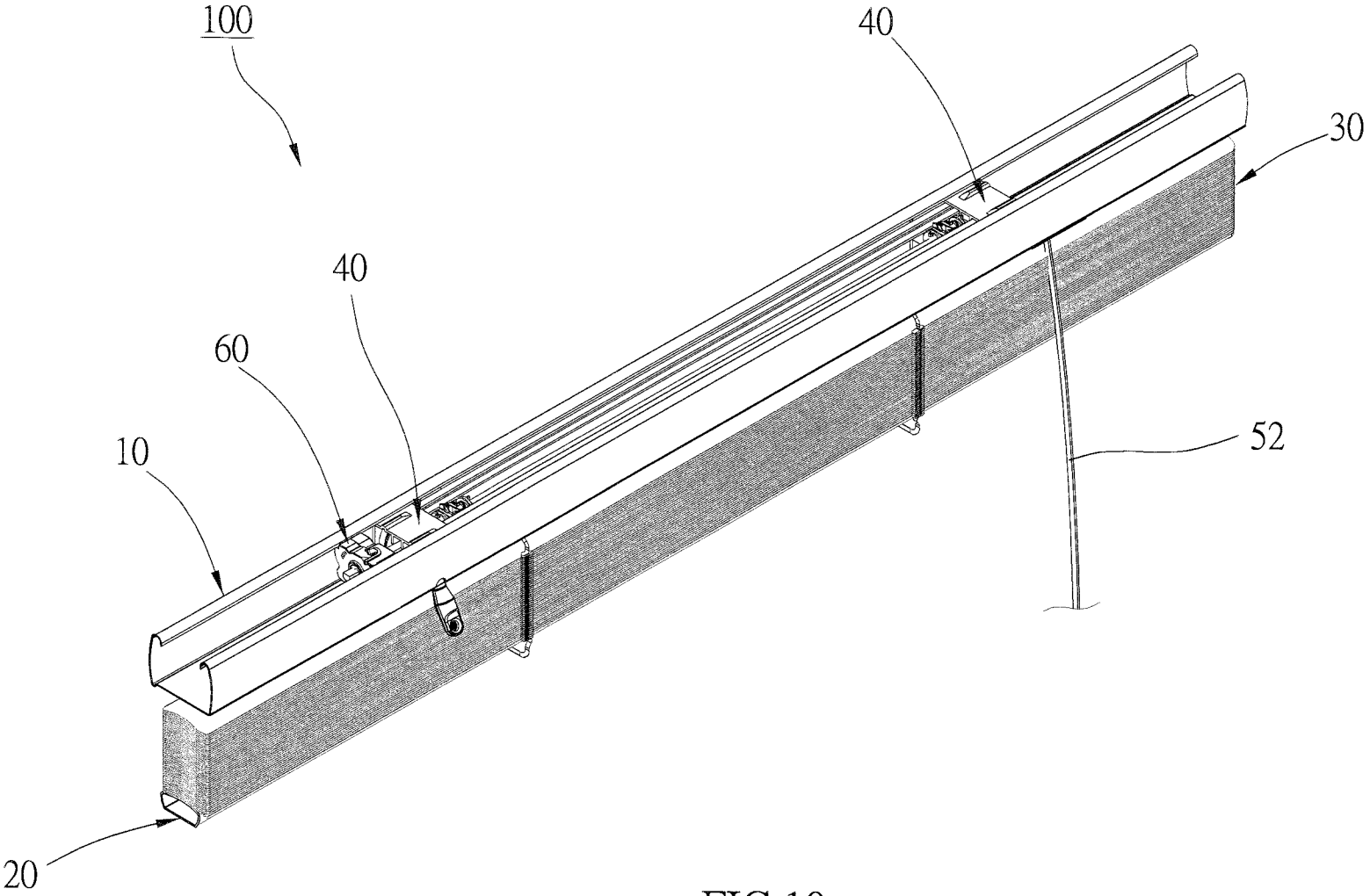
FIG. 10 is a perspective view of the first preferred embodiment of the present invention, showing the bottom rail being lifted.

As shown in FIG. 3 and FIG. 9, the cord 50 has a single control section 52 and two lift sections 54. In an embodiment, the cord 50 is a Y-shaped woven cord with a trunk section and two branch sections. The trunk section forms the single control section 52, and the branch sections form the lift sections 54. The cord 50 runs over the carrier portions 44*c* of the pulleys 44 of the pulley assemblies 40. The protrusions 44*b* on the pulleys 44 isolate the cord 50 to make it unable to twist. The single control section 52 has a first end 52*a* and a second end 52*b* (FIG. 9), and the first end 52*a* passes through a cord fastener 70 in the headrail 10, which is used to fasten or release the single control section 52, and extends out of the headrail 10 (FIG. 1). The second end 52*b* of the single control section 52 is connected to ends of the lift sections 54. More specifically, the single control section 52 runs over the carrier portions 44*c* of the pulleys 44 of the pulley assemblies 40 in the headrail 10. The lift sections 54 respectively extend out of the frames 42 via the openings 42*c*, extend through the headrail 10 and the slats 32 in sequence, and finally are fastened to the bottom rail 20. User holds the single control section 52 to lift or lower the bottom rail 10 and the slats 32.

Figure 11:
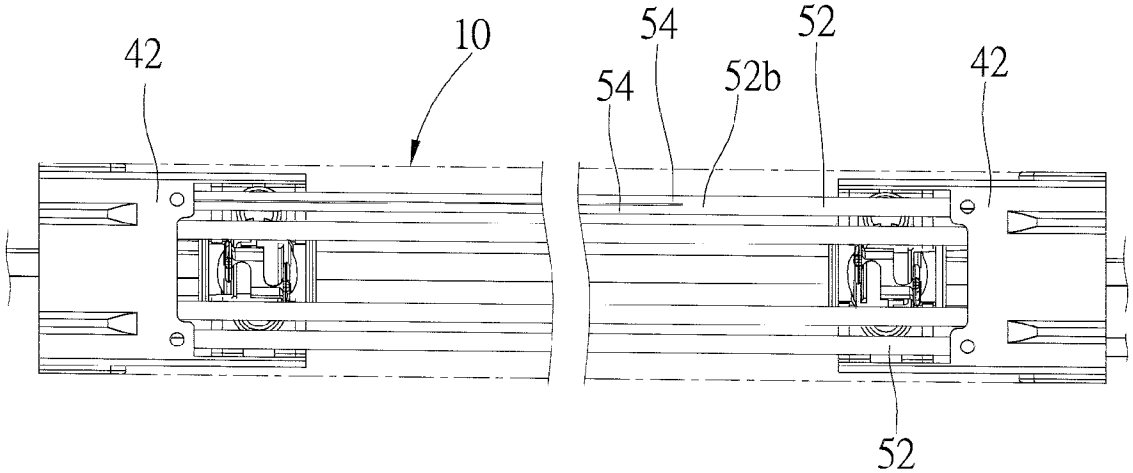
FIG. 11 is a top view of the first preferred embodiment of the present invention, showing inside of the top rail when the bottom rail is lowered.
Figure 12:
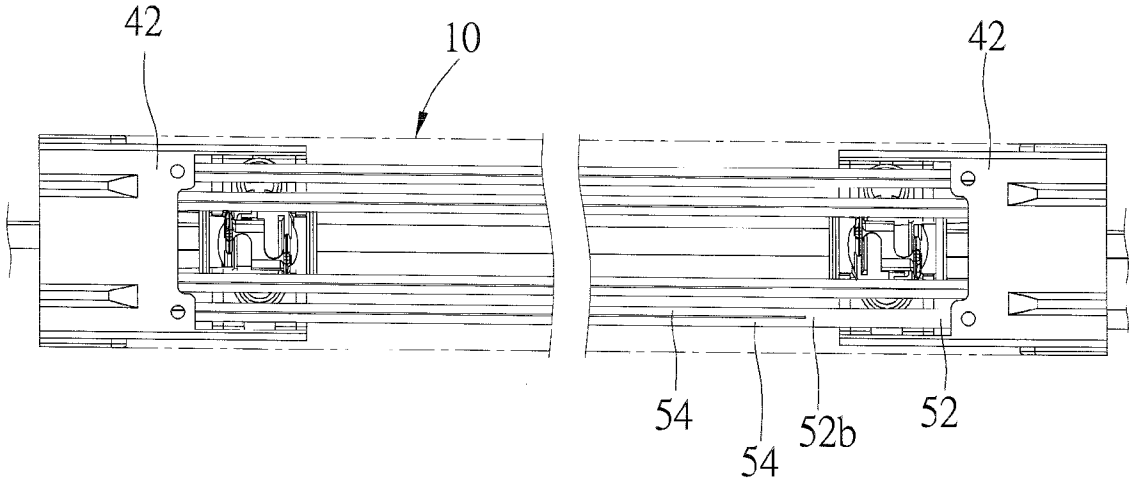
FIG. 12 is a top view of the first preferred embodiment of the present invention, showing inside of the top rail when the bottom rail is lifted.

As shown in FIG. 11 and FIG. 12 the second end 52*b* of the single control section 52, which is connected to the lift sections 54, is usually received in the headrail 10, no matter the bottom rail 20 is lowered or lifted. If the second end 52*b* of the single control section 52 goes out of the headrail 10 when the bottom rail 20 is lifted, which means that the lift sections 54 will have parts going out of the headrail 10 as well, it will have a hole between the lift sections 54. If the hole is large enough, it may cause accident.

Figure 13:
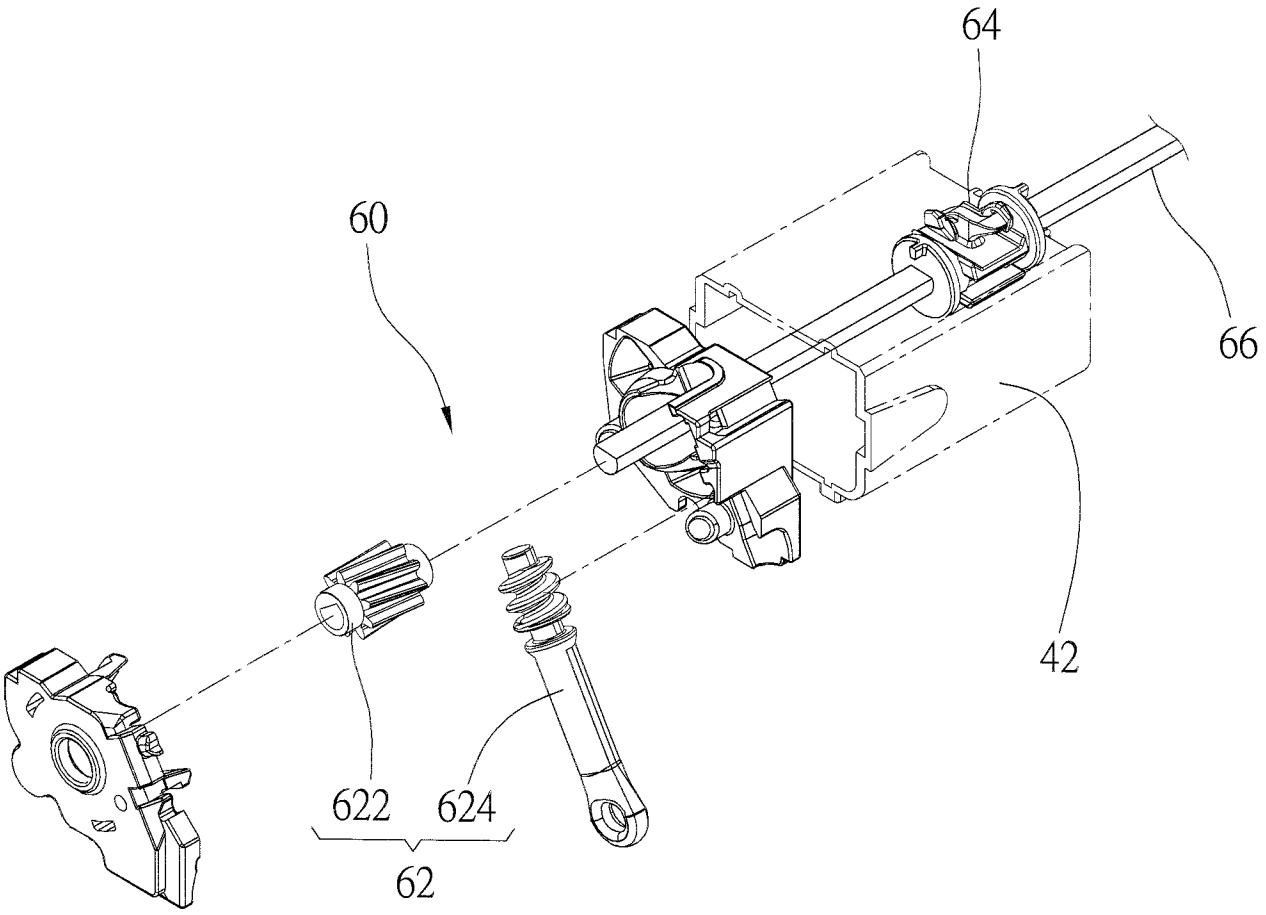
FIG. 13 is an exploded view of the tilting assembly of the first preferred embodiment of the present invention.

As shown in FIG. 13, the tilting assembly 60 has a driving device 62, two fixing devices 64, and a shaft 66. The driving device 62 has a driven member 622 and a driving member 624, which is meshed with the driven member 622. The fixing devices 64 are rested against the holding portions 42*b* of the frames 42 respectively. Ends of the ladders 34 are fastened to the fixing devices 64 (not shown). The fixing devices 64 are on the shaft 66, and the driven member 622 are connected to an end of the shaft 66. Therefore, the ladders 34 will be moved by turning the driving member 624 to tilt the slats 32.

It is noted that the cord 50 can be a woven Y-shaped cord, so that the single control section 52 and the lift sections 54 are on a single cord. It has a strong strength to sustain large stress, therefore it won't worry about break of the cord 50. In addition, the single cord 50 is helpful for a smooth movement of the cord 50 and to keep the bottom rail 20 horizontal.

The protrusion 44*b* on the pulley 44 separates the cord 50 on the carrier portions 44*c* to prevent the cord 50 from twisting. The sloped carrier portion 44*c* may prevent the cord 50 from escaping from the pulleys 44. The cord 50 can be a flat cord (so are the single control section 52 and the lift sections 54) which makes the cord 50 has more area in contact with the pulleys 44 for a smooth movement. The pulleys 44 in the present embodiment are easy to be assembled and disassembled.

Figure 14:
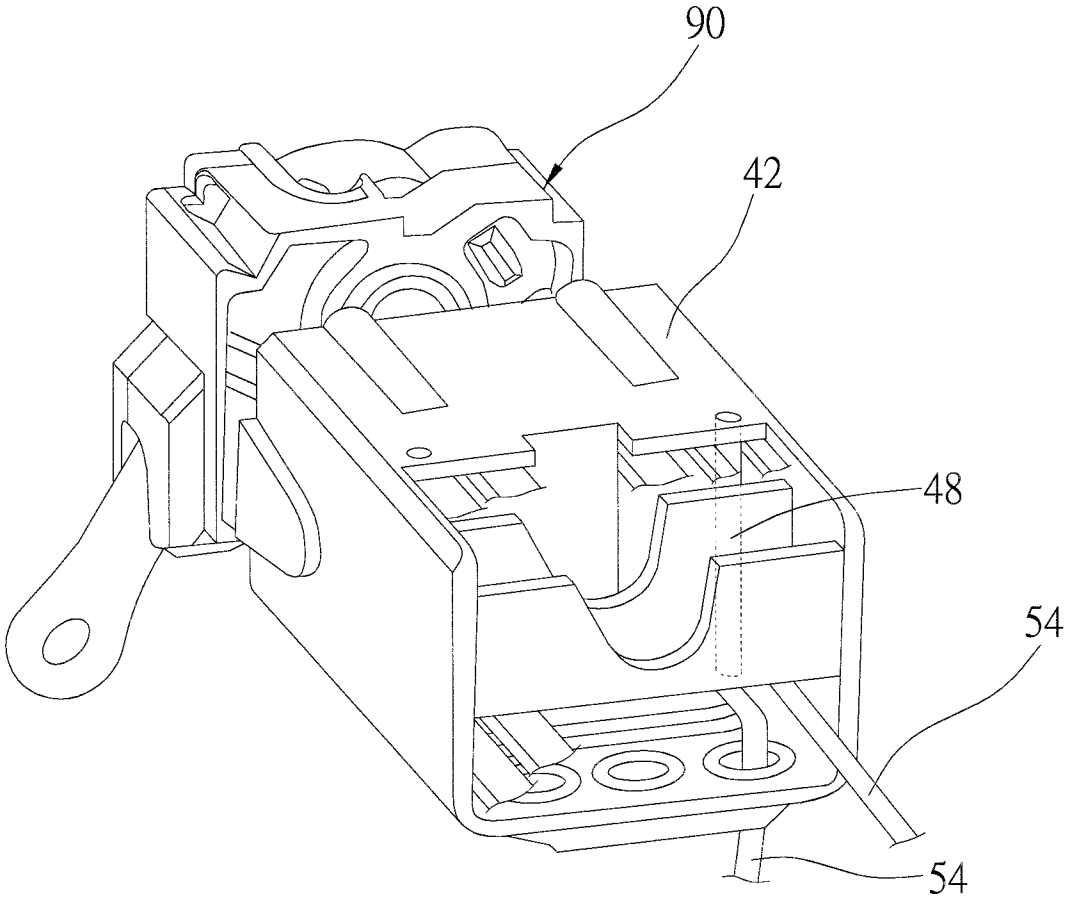
FIG. 14 is a perspective view of the frame of the first preferred embodiment of the present invention, showing the separating member on the frame.

FIG. 14 shows the frame 42 is provided with a separating member 48. The separating member 48 is a post between the lift sections 54 of the cord 50 to further prevent them from twisting.

Figure 15:
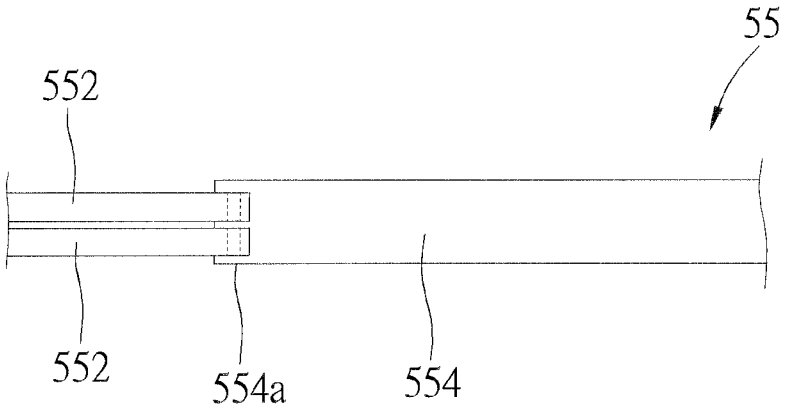
FIG. 15 is a top view of the cord of the second type.
Figure 16:
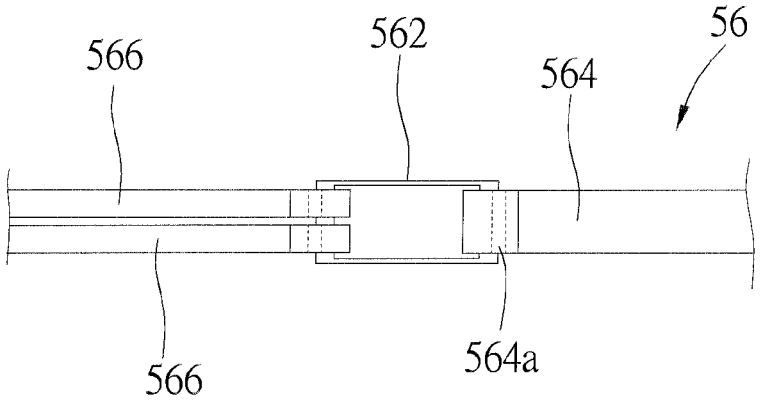
FIG. 16 is a top view of the cord of the third type.
Figure 17:
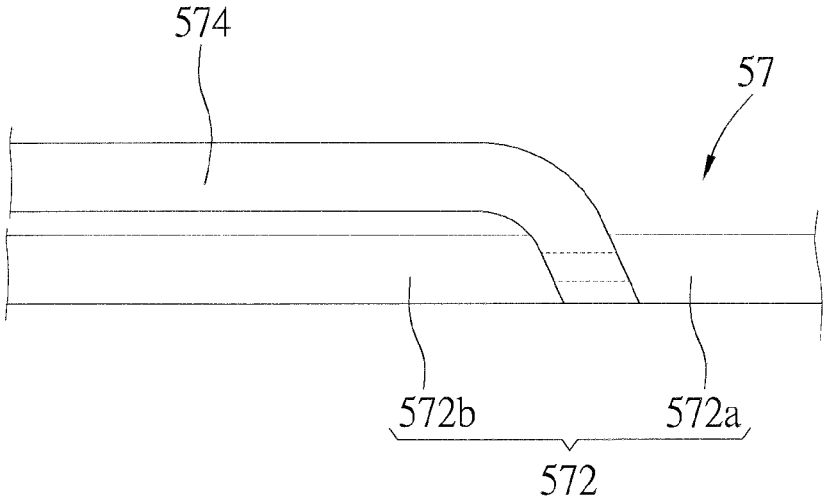
FIG. 17 is a top view of the cord of the fourth type.
Figure 18:
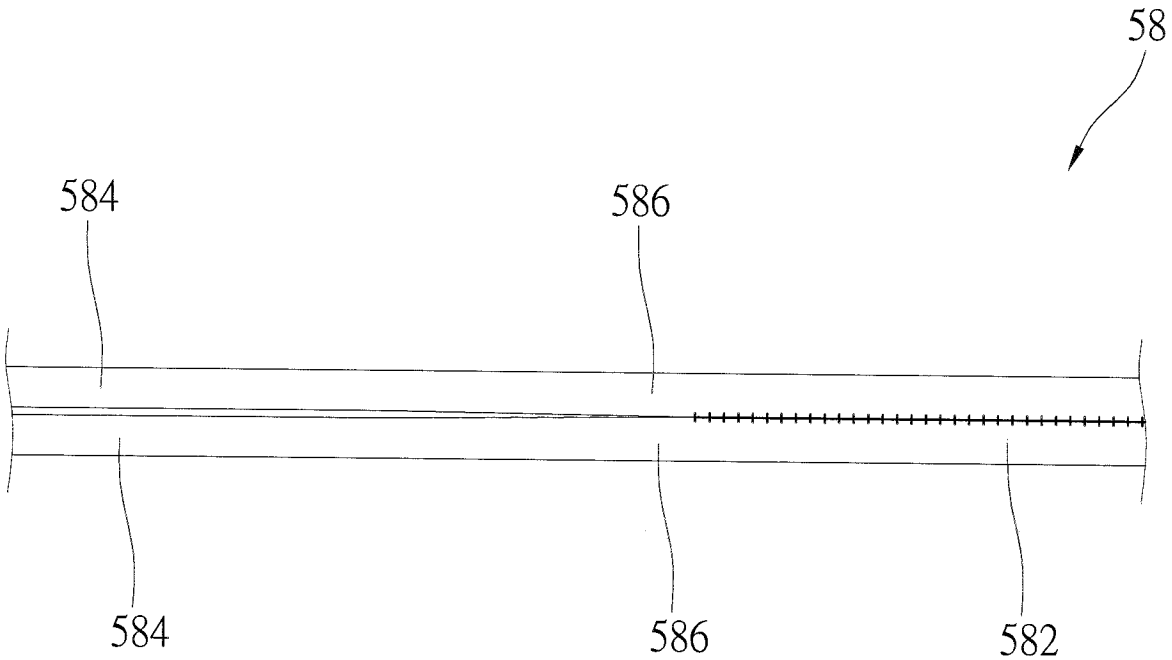
FIG. 18 is a top view of the cord of the fifth type.

In practices, there are various kinds of cords, which may be applied in the present invention except for the cord 50 as described above. The connection method of the single control section and the multiple lift sections can vary, including but not limited to sewing, knotting, bonding and gluing. FIG. 15 shows a cord 55 having two lift sections 552 connected to a second end 554*a* of a single control section 554 by sewing. FIG. 16 shows a cord 56 having two lift sections 566 connected to a second end 564*a* of a single control section 564 through a connector 562. In an embodiment, the connector 562 is a rectangular ring, and the lift sections 566 and the single control section 564 are fastened to opposite sides of the ring respectively. FIG. 17 shows a cord 57 having a main cord 572 and a branch cord 574 connected to a predetermined point of the main cord 572. At the right side of the point of the main cord 572 is a single control section 572*a*, and the left side is a lift sections 572*b*. The branch cord 574 forms another lift section. FIG. 18 shows a cord 58 having two parallel bands 586. Parts of the bands 586 are sewed together, and the rest are not. As a result, the sewing parts forms a single control section 582, and unsewing parts form two lift sections 584.

Figure 19:
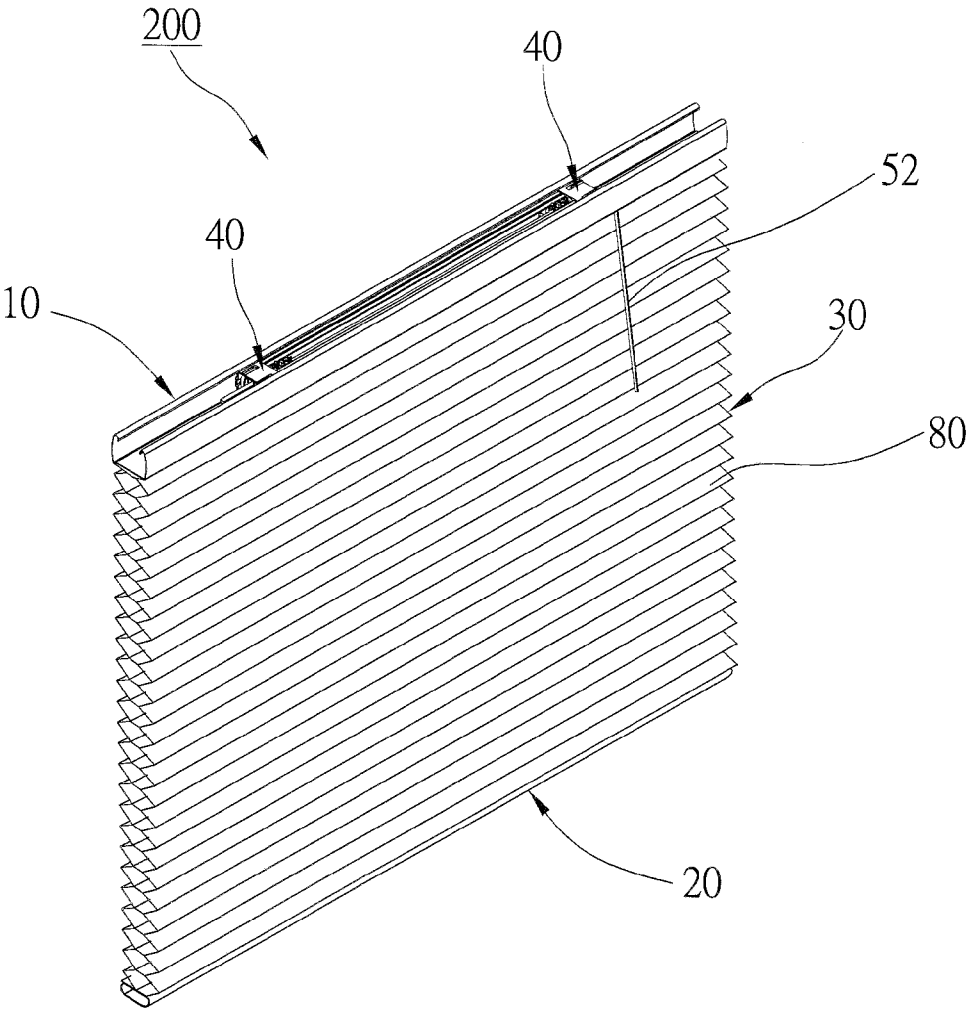
FIG. 19 is a perspective view of a second preferred embodiment of the present invention.

FIG. 19 shows a window covering 200 of the second preferred embodiment of the present invention, which is similar to the first embodiment, except that the shading member 30 is a cellular shade 80, and there is no ladder and tilting assembly. The same as the first embodiment, user may pull or release the single control section 52 to lift or lower the bottom rail 20.

Figure 20:
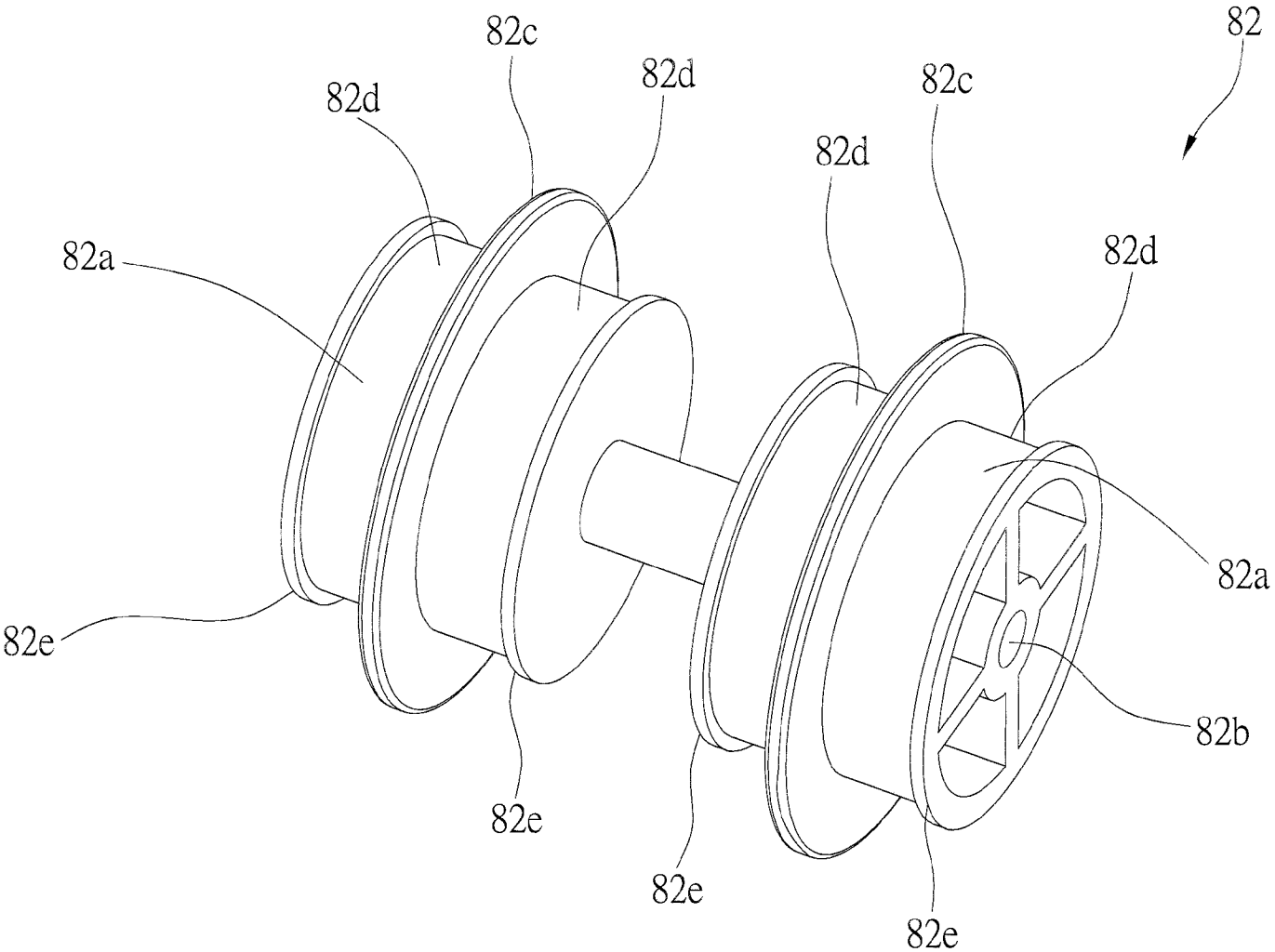
FIG. 20 is a perspective view of another pulley.

FIG. 20 shows a pulley 82, which has two wheels 82*a* and an axle. Each wheel 82*a* has a bore 82*b* at a center thereof, a protrusion 82*c* and two flanges 82*e* around a circumference thereof. The protrusion 82*c* is between the flanges 82*e*, so that there are two isolated carrier portions 82*d* on the circumference. The cord 50 is kept in the carrier portions 82*d* by the protrusion 82*c* and the flanges 82*e*, so that the carrier portions 82*d* of the pulley 82 do not need a slope like the pulley 44 of the first embodiment. The pulley 82 has the same function as the pulley 44 of the first embodiment.

It is noted that the pulleys of the present invention can be rotatable, as described in the aforementioned preferred embodiments, or can be completely fixed on the frame, i.e., not rotatable, in other embodiments. They have the same function anyway. In some window coverings, there might be three or more lift cords. The present invention may be applied in such window covering also. It may provide the cord with three or more lift sections, which are connected to single control section in parallel, and pulleys with two or more protrusions to form three or more carrier portions on each pulley for the lift sections. It may achieve the same function.

It must be pointed out that the embodiments described above are only some preferred embodiments of the present invention. All equivalent structures which employ the concepts disclosed in this specification and the appended claims should fall within the scope of the present invention.

What is claimed is:

1. A window covering, comprising:

a headrail;

a bottom rail;

a shading member between the headrail and the bottom rail;

two pulley assemblies received in the headrail, each of which has a pulley; and a cord, which runs over the pulleys of the pulley assemblies, having a single control section and at least two lift sections, wherein the single control section has a first end and a second end, and the second end is connected to an end of each of the at least two lift sections; the single control section extends out of the headrail to be operated by a user to expand or collapse the shading member, and the at least two lift sections extend out of the headrail respectively to connect to the bottom rail through the shading member; the second end of the single control section is always inside the headrail no matter whether the shading member is expanded or collapsed;

wherein the single control section runs over each of the pulleys of the pulley assemblies more than once in the headrail when the shading member is expanded.

2. The window covering of claim 1, wherein the cord is a woven Y-shaped cord having a trunk section and two branch sections; and the trunk section forms the single control section, and the branch sections form the lift sections respectively.

3. The window covering of claim 1, wherein the cord has at least two bands; a first part of each of the at least two bands is connected together to form the single control section, and a remainder part of each of the at least two bands forms one of the at least two lift sections respectively.

4. The window covering of claim 1, wherein the at least two lift sections are connected to the single control section by sewing, knotting, bonding, or gluing.

5. The window covering of claim 1, wherein the at least two lift sections comprise a first lift section and a second lift section; the cord has a main cord and a branch cord connected to a predetermined point of the main cord so that the main cord is divided into two sections by the predetermined point, wherein one of the two sections of the main cord forms the single control section, while the other one of the two sections forms the first lift section, and the branch cord forms the second lift section.

6. The window covering of claim 1, wherein each pulley assembly further includes a frame; the frame is connected to the headrail, and the pulley is connected to the frame.

7. The window covering of claim 6, wherein the frame has an opening through which one of the lift sections pass.

8. The window covering of claim 1, wherein the cord further has a connector, and the second end of the single control section and the at least two lift sections are connected to the connector.

9. The window covering of claim 8, wherein the connector is a ring.

* * * * *